US011128061B2

(12) United States Patent
Pohle et al.

(10) Patent No.: US 11,128,061 B2
(45) Date of Patent: Sep. 21, 2021

(54) LOW-, MEDIUM- AND/OR HIGH-VOLTAGE INSTALLATION WITH A BONDED CURRENT PATH CONNECTION WITH LONG-TERM STABILITY BY MEANS OF NANOMATERIALS, AND METHOD FOR PRODUCING SAID CURRENT PATH CONNECTION

(71) Applicant: SIEMENS AKTIENGESELLSCHAFT, Munich (DE)

(72) Inventors: Dirk Pohle, Forchheim (DE); Philipp Last, Berlin (DE); Kira Berdien Wuestenberg, Berlin (DE); Christian Werner, Falkensee (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 16/340,195

(22) PCT Filed: Sep. 15, 2017

(86) PCT No.: PCT/EP2017/073246
§ 371 (c)(1),
(2) Date: Apr. 8, 2019

(87) PCT Pub. No.: WO2018/065187
PCT Pub. Date: Apr. 12, 2018

(65) Prior Publication Data

US 2019/0312363 A1 Oct. 10, 2019

(30) Foreign Application Priority Data

Oct. 6, 2016 (DE) ..... 102016219374.0

(51) Int. Cl.
*H01R 4/02* (2006.01)
*H01R 4/18* (2006.01)
(Continued)

(52) U.S. Cl.
CPC ..... *H01R 4/029* (2013.01); *H01R 4/04* (2013.01); *H01R 4/187* (2013.01); *H01R 4/58* (2013.01);
(Continued)

(58) Field of Classification Search
CPC ..... H01R 4/029; H01R 4/187; H01R 4/58; H01R 4/06; H01R 4/28; H01R 43/02
See application file for complete search history.

(56) References Cited

U.S. PATENT DOCUMENTS 2,571,261 A * 10/1951 Lamb ..... H01R 4/50 439/863
3,994,090 A * 11/1976 Wheeler ..... H02G 15/08 40/316
(Continued)

FOREIGN PATENT DOCUMENTS

CN 101536255 A 9/2009
CN 101635394 A 1/2010
(Continued)

*Primary Examiner* — William H. Mayo, III
*Assistant Examiner* — Rhadames Alonzo Miller
(74) *Attorney, Agent, or Firm* — Laurence A. Greenberg; Werner H. Stemer; Ralph E. Locher

(57) ABSTRACT

A method for establishing a materially bonded current path connection in low-voltage, medium-voltage and/or high-voltage installations having long-term stability includes providing a first part and/or a second part of a current path with a nanomaterial at least in one region. The first part and the second part of the current path are force-lockingly or form-lockingly connected at least in the respective regions. A supply of a reaction energy together with the nanomaterial creates a conductive and bonded connection between the
(Continued)

first part and the second part of the current path. A low-voltage installation, a medium-voltage installation and/or a high-voltage installation is also provided.

10 Claims, 1 Drawing Sheet

(51) Int. Cl.

| | |
|---|---|
| ***H01R 4/58*** | (2006.01) |
| ***H01R 43/02*** | (2006.01) |
| ***H01R 4/04*** | (2006.01) |
| ***H01R 4/06*** | (2006.01) |
| ***H01R 4/28*** | (2006.01) |

(52) U.S. Cl.
CPC ..... *H01R 43/02* (2013.01); *H01R 4/02* (2013.01); *H01R 4/06* (2013.01); *H01R 4/18* (2013.01); *H01R 4/28* (2013.01)

(56) References Cited

U.S. PATENT DOCUMENTS

| | | | | |
|---|---|---|---|---|
| 4,334,122 | A | 6/1982 | Bennett | |
| 5,134,040 | A * | 7/1992 | Benz | H01L 39/02 428/646 |
| 7,311,554 | B1 * | 12/2007 | Jackson | H01R 9/0521 439/584 |
| 9,379,458 | B2 | 6/2016 | Jenrich | |
| 2003/0059562 | A1 * | 3/2003 | Lien | B60R 16/0215 428/36.9 |
| 2007/0209821 | A1 * | 9/2007 | Otsuki | H01R 13/5213 174/88 R |
| 2008/0207051 | A1 * | 8/2008 | Montena | H01R 9/0521 439/578 |
| 2010/0018743 | A1 | 1/2010 | Touwslager et al. | |
| 2010/0018766 | A1 * | 1/2010 | Shimonishi | B60R 16/0215 174/72 C |
| 2010/0018768 | A1 | 1/2010 | Takahashi et al. | |
| 2011/0123759 | A1 * | 5/2011 | Rodrigues | H02G 3/0481 428/100 |
| 2011/0185544 | A1 * | 8/2011 | Torlay | H02G 3/0481 24/451 |
| 2012/0032550 | A1 * | 2/2012 | Wolf | B23K 1/0006 310/198 |
| 2012/0231230 | A1 * | 9/2012 | Siebert | C09J 7/38 428/189 |
| 2014/0008103 | A1 * | 1/2014 | Chassaigne | H01B 17/02 174/158 R |
| 2015/0344138 | A1 * | 12/2015 | Wen | H05B 3/286 219/541 |
| 2016/0086695 | A1 | 3/2016 | Mann et al. | |
| 2016/0343467 | A1 * | 11/2016 | Wen | C23C 16/06 |

FOREIGN PATENT DOCUMENTS

| | | | |
|---|---|---|---|
| CN | 102362416 | A | 2/2012 |
| CN | 102386490 | A | 3/2012 |
| CN | 102959803 | A | 3/2013 |
| CN | 105390902 | A | 3/2016 |
| DE | 69125431 | T2 | 10/1997 |
| DE | 102009002135 | A1 | 10/2010 |
| WO | 2010108726 | A1 | 9/2010 |

* cited by examiner

LOW-, MEDIUM- AND/OR HIGH-VOLTAGE INSTALLATION WITH A BONDED CURRENT PATH CONNECTION WITH LONG-TERM STABILITY BY MEANS OF NANOMATERIALS, AND METHOD FOR PRODUCING SAID CURRENT PATH CONNECTION

BACKGROUND OF THE INVENTION

Field of the Invention

The invention relates to a method for establishing a materially bonded current path connection in low-, medium- and/or high-voltage installations, and to a low-, medium-voltage installation and/or high-voltage installation with a materially bonded current path connection with long-term stability.

In low-voltage installations, medium-voltage installations and high-voltage installations, the current is carried by means of lines, in the so-called current path. The same applies to low-, medium- and high-voltage switching devices which are also intended to be covered by the terms low-, medium-voltage installations and high-voltage installations in the text which follows.

When carrying the rated current in a conductor, heat is produced due to the non-reactive resistance of the current path of the switchgear installation. In order to guarantee long-term functionality of the switchgear installations, it is necessary to ensure that the components which are installed in the device, in particular the conductors which form current paths, withstand this heating over the long term. Since, in connection with switching devices, the long term generally refers to the entire service life of the switching device, particular requirements are made of the current paths of the switchgear installations.

In this context, force-locking connecting points in the current path in particular are considered to be critical. Force-locking connecting points of this kind, generally screw points or clamping points, run the risk of their resistance increasing to a considerable extent over the course of the service life due to, for example, corrosion. An increase in the resistance in the current path necessarily leads to higher temperatures in the affected regions. This entails the risk of critical temperatures being reached and/or exceeded, with the result that the switchgear installation is no longer suitable for carrying the intended rated current under the potential or prespecified environmental conditions.

This is particularly critical since force-locking connections usually have a higher electrical resistance than other types of connections and therefore exacerbate the heating problem or said heating problem only occurs as a result.

The problem of increasing the resistance in force-locking connections over the course of the service life of a switchgear installation is addressed in the prior art by the use of materially bonded connections, weld connections or solder connections.

However, establishing weld or solder connections is generally associated with an increase in the temperature of the components which are to be connected. For sensitive components, such as vacuum interrupters for example, or other temperature-sensitive components and, in particular, plastic components which are contained therein, cost-effective, simple welding or soldering is very critical because there is a risk of the process heat damaging or destroying said components during joining and therefore the functioning of said components no longer being guaranteed.

In the prior art, very expensive welding methods, such as electron beam welding or laser welding for example, which lead only to locally limited heating, in particular in the direct vicinity of the connecting point, of the components which are to be connected, are generally used for components of this kind.

SUMMARY OF THE INVENTION

The object of the invention is therefore to provide a conductive connection, with long-term stability, for conducting current in a switchgear installation, which connection remedies the disadvantages of the prior art, and respectively to provide cost-effective and less complicated production of connections of electrical current paths.

This object is achieved by a method for establishing a materially bonded current path connection in low-voltage, medium-voltage and/or high-voltage installations, in which a current path has at least one first portion and one second portion. The first portion and/or the second portion of the current path each contain a nanomaterial at least in one region. The first portion and the second portion of the current path are connected to one another in a force-locking and/or form-locking manner at least in the respective regions. A conductive and materially bonded connection between the first portion and the second portion of the current path is formed, with involvement of the nanomaterial, by supplying reaction energy. The object is also achieved by a low-voltage installation, medium-voltage installation and/or high-voltage installation, in which the low-voltage installation, medium-voltage installation and/or high-voltage installation has a current path and at least one connection of a first portion of the current path to a second portion of the current path, in which the connection is force-locking and materially bonded.

One exemplary embodiment relates to a method for establishing a materially bonded current path connection in low-voltage installations, medium-voltage installations and/or high-voltage installations, wherein a current path has at least one first portion and one second portion. The first portion and/or the second portion of the current path each contain a nanomaterial at least in one region. The first and the second portion of the current path are connected to one another in a force-locking and/or form-locking manner at least in the respective regions. A conductive and materially bonded connection between the first portion and the second portion of the current path is formed, with involvement of the nanomaterial, by supplying reaction energy. In the text which follows, the nanomaterial may be present as such or as a precursor of the nanomaterial, that is to say the actual nanomaterial is formed from a precursor due to a reaction, preferably by supplying reaction energy which also leads to the formation of the materially bonded connection.

A nanomaterial is a material of which the individual units or in which one or more dimensions lie in an order of magnitude of between 1 and 1000 nanometers ($10^{-9}$ meters, one billionth of a meter), preferably between 1 and 100 nanometers.

Within the meaning of this application, the term "region" is understood to mean the connecting region, that is to say the region in which the first portion and the second portion of the current path are connected to one another by means of the nanomaterial.

Within the meaning of this application, the term "conductive" is understood to mean that the conductive portions of a current path which are connected to one another are conductive over the connection in such a way that loading with or below the rated current of the switchgear installation does not lead to any adverse effects in respect of functioning, not even to heating of the connecting point which exceeds the permissible temperatures.

Using the nanomaterial and changing the purely force-locking connection into a materially bonded and/or force-locking connection by supplying reaction energy ensures a connection with long-term stability which, in accordance with standards, is classified as a materially bonded connection and therefore also does not require any additional expenditure on checking as in the case of force-locking or form-locking connections for example.

In particular, a force-locking connection and/or a form-locking connection, in which a pressure is exerted onto the connecting point between the first portion of the current path and the second portion of the current path, have/has a positive effect on the formation of the materially bonded connection of the first portion of the current path and the second portion of the current path.

The nanomaterial is preferably located between the respective regions of the first portion and of the second portion of the current path which are connected to one another in a force-locking and/or form-locking manner or the nanomaterial extends beyond the respective regions of the first portion and/or of the second portion of the current path.

Owing to the complete or virtually complete presence of nanomaterial in the connecting region of the current path, a low electrical resistance of the connecting region and/or a resistance to aging is achieved. Here, the connecting region further means the region in which the first portion and the second portion of the current path are connected by means of the nanomaterial and the force-locking connection and/or the form-locking connection.

Preference is further given to the first portion and the second portion of the current path being formed from the same conductive material and/or the same material combination. As an alternative, the first portion and the second portion of the current path can be formed from different conductive materials and/or different material combinations, in particular copper and silver or copper alloys and silver alloys are relevant for different pairings.

Preference is also given to the nanomaterial and/or a precursor of the nanomaterial being applied to the respective region of the first and/or of the second portion of the current path and/or being present on the respective region of the first portion and/or of the second portion of the current path in the form of a paste, a foil and/or a powder. Therefore, both the two portions or only one portion of the current path which is to be connected can contain the nanomaterial.

Particular preference is given to a foil being formed from the nanomaterial, in particular by printing, particularly by screen printing, or doctoring or painting onto a transfer material from which the foil, which is produced by, for example, drying, curing or pressing, can be released. As an alternative, the transfer material can also be converted, incorporated into the connection or removed when forming the materially bonded connection.

Preference is also given to the first portion and the second portion of the current path being connected in a force-locking manner by one or more connecting means. In particular, preference is given to the respective regions of the first portion and of the second portion of the current path being connected in a force-locking manner by one or more connecting means. The force-locking connection has the effect that a pressure acts on the connecting point, this having a positive effect on forming the connection of the first portion of the current path and the second portion of the current path.

Particular preference is given to the connecting means being formed with one or more means from amongst screws, rivets and/or clamps.

Preference is also given to the first portion and the second portion of the current path being connected to one another in a form-locking manner.

Preference is also given to the first portion of the current path being an electrically conductive and flexible current conductor or a pole head or a current conductor clamp, and/or the second portion of the current path being a connection to:

a moving contact or fixed contact of a vacuum interrupter; or a transformer; or a busbar.

Preference is also given to supplying the reaction energy leading to a reaction being locally limited to the first portion, which adjoins the nanomaterial, and the second portion, which adjoins the nanomaterial, of the current path to form a materially bonded connection between the first portion and the second portion of the current path.

Preference is further given to the reaction energy being supplied to the nanomaterial in the form of thermal energy and/or electrical energy, and/or the reaction energy being supplied in another form and being converted into thermal energy and/or electrical energy in and/or on the nanomaterial. However, it is also possible to supply the reaction energy into the material in the form of electromagnetic oscillations, waves and/or induced oscillations and/or shock waves.

Preference is also given to the materially bonded connection of the first portion, the second portion of the current path and the nanomaterial, which materially bonded connection is created by supplying the reaction energy, being based on a sintering process of the nanomaterial or comprising a sintering process of the nanomaterial and/or being based on welding and/or soldering of the first portion and the second portion of the current path due to an exothermic reaction of the nanomaterial or of a portion of the nanomaterial. In the sintering process, the nanomaterial is inherently connected and at least partially or completely connected to the first and the second portion of the current path. During the exothermic reaction, the first and the second portion of the current path can be directly welded to one another and/or can be welded with the incorporation of the nanomaterial or constituent parts thereof and/or the first and the second portion of the current path can be soldered with involvement of the nanomaterial or further materials. In this case, the further materials can also be, in particular, a constituent part of the nanomaterial or can have been formed during the exothermic reaction.

Preference is also given to the nanomaterial containing silver and/or a silver precursor.

Preference is also given to nanomaterial which contains silver nanoparticles in agglomerates with dimensions in at least one spatial direction of more than 90 nm, in particular more than 100 nm or 200 nm, and less than 300 nm; in particular preference is also given to the silver nanoparticles being formed under a corresponding reaction temperature and/or under corresponding reaction conditions and having a size of from 1 nm to 20 nm in at least one spatial direction.

Further preference is given to the silver nanoparticles being at least partially formed by a reaction in an organometallic precursor.

A further exemplary embodiment is a low-voltage installation, medium-voltage installation and/or high-voltage installation, wherein the low-voltage installation, medium-voltage installation and/or high-voltage installation have/has a current path, and have/has at least one connection of a first portion of the current path to a second portion of the current path, wherein the connection is force-locking and materially bonded.

A further exemplary embodiment is a low-voltage installation, medium-voltage installation and/or high-voltage installation, wherein the low-voltage installation, medium-voltage installation and/or high-voltage installation have/has a current path, wherein the current path is formed in accordance with one of the embodiments above.

BRIEF DESCRIPTION OF THE SEVERAL VIEWS OF THE DRAWING

The subject matter of the invention will be explained in more detail below with reference to three figures, in which.

DESCRIPTION OF THE INVENTION

Figure 1:
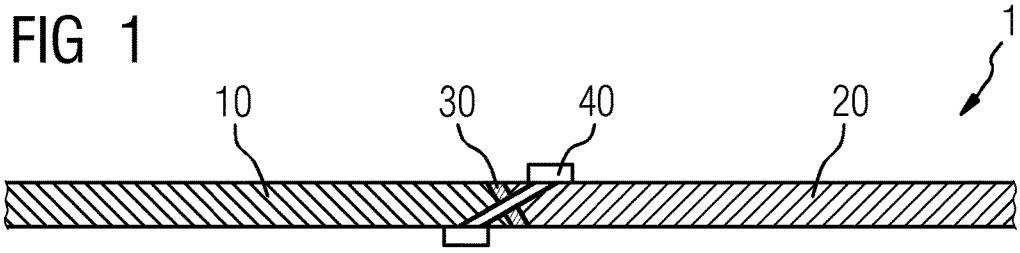
FIG. 1: shows a materially bonded and force-locking connection according to the invention of a first and a second portion of a current path.

FIG. 1 shows a connection according to the invention in a switchgear installation 1, not illustrated in any detail, wherein a first portion 10 of a current path is connected to a second portion 20 of a current path in a force-locking manner by means of a connecting means 40 and in a materially bonded manner by means of a nanomaterial 30.

The force-locking connection 40 can be achieved, for example, by screws, rivets and/or clamps. As an alternative to the force-locking connection using a connecting means 40, a form-locking connection—not shown here—can also be used. The form-locking connection can be made, for example, by connecting regions of the first and of the second portion of the current path latching into one another or by shaping, for example pressing or crimping.

Figure 2:
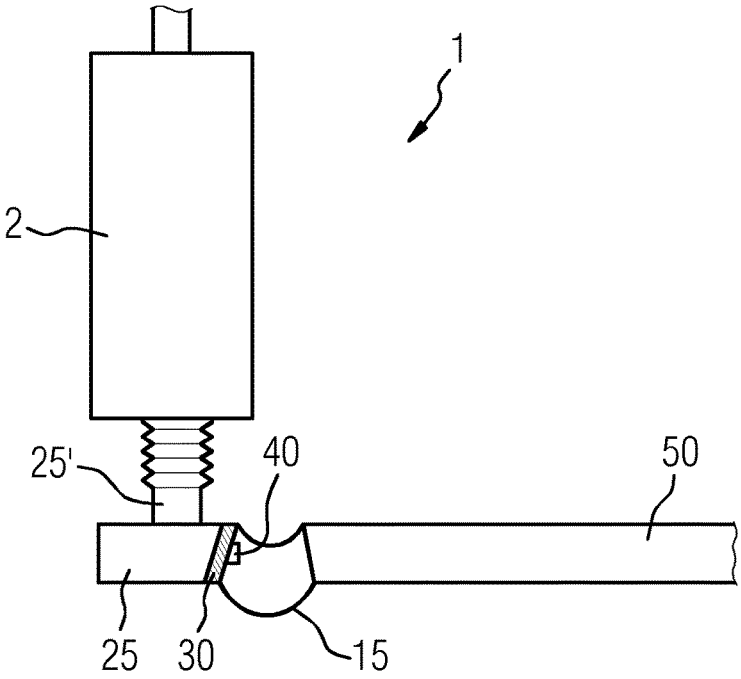
FIG. 2: shows a schematic illustration of a connection of a vacuum interrupter to a conductive and flexible current conductor by means of nanomaterials.

FIG. 2 shows the connection of a vacuum interrupter 2 in a switchgear installation 1, not illustrated in any detail, wherein the moving contact connection 25 and the flexible current conductor 15 are firstly connected to one another in a force-locking manner by means of a connecting means 40 and secondly are connected to one another in a materially bonded manner by means of a nanomaterial 30. As an alternative—not shown here —, the moving contact bolt 25' and the flexible current conductor 15 can also firstly be connected to one another in a force-locking manner by means of a connecting means 40 and secondly be connected to one another in a materially bonded manner by means of a nanomaterial 30. In this example, the flexible current conductor 15 is connected in a materially bonded manner to a further portion 50 of the current path, wherein said materially bonded connection is a conventional weld or solder connection.

Figure 3:
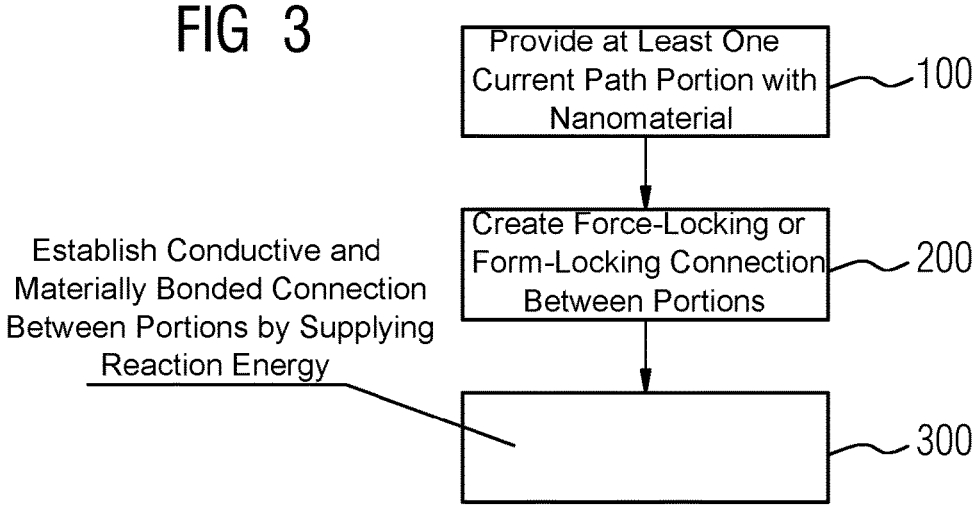
FIG. 3: shows a flowchart of a method according to the invention for establishing a materially bonded and force-locking current path connection.

FIG. 3 shows a schematic sequence of the method according to the invention for establishing a materially bonded and form-locking and/or form-locking connection of a first and a second portion of a current path in a switchgear installation 1, in particular a switchgear installation for medium voltages and/or high voltages. In a first step 100, the first portion of a current path and/or the second portion of a current path are provided with a nanomaterial at least in one region, or the portions of the current path which are provided with a nanomaterial are provided. This also includes the nanomaterial being provided in the form of a foil or lattice and the foil or the lattice being placed on the first portion of a current path and/or the second portion of a current path or between said first portion and second portion.

In a second step 200, a force-locking and/or form-locking connection is created between the first portion of the current path and the second portion of the current path.

In a third step 300, a conductive and materially bonded connection between the first portion of the current path and the second portion of the current path is established, with involvement of the nanomaterial, by supplying reaction energy. In this case, the nanomaterial can either form the conductive connection by a process comprising a sintering process or can effect an exothermic reaction, which welds the first portion of the current path to the second portion of the current path, by supplying reaction energy.

List of Reference Symbols

1 Switchgear installation
2 Vacuum interrupter
10 First portion of a current path
15 Conductive, flexible current conductor as first portion of the current path
20 Second portion of a current path
25 Moving contact connection of a vacuum interrupter as second portion of the current path
25' Moving contact bolt of a vacuum interrupter as second portion of the current path
30 Nanomaterial
40 Connecting means, for example screw, rivet or clamp
50 Further portion of the current path
100 Step 1
200 Step 2
300 Step 3

The invention claimed is:

1. A method for establishing a materially bonded current path connection in at least one of medium-voltage or high-voltage switchgear installations having a current path with at least one first portion and one second portion, the method comprising the following steps:

providing a nanomaterial in at least one region of at least one of the first portion or the second portion of the switchgear installation current path;

providing a first permanent connection of the first portion and the second portion of the current path to one another in at least one of a force-locking or form-locking manner at least in the respective regions;

forming a permanent conductive and materially bonded second connection between the first portion and the second portion of the current path with participation of the nanomaterial by supplying reaction energy:

not removing the first permanent force-locking or form-locking connection after forming the permanent conductive and materially bonded second connection; and providing at least one of:

the first portion of the current path as an electrically conductive and flexible current conductor or a pole head or a current conductor clamp, or the second portion of the current path as a connection to a moving contact or fixed contact of a vacuum interrupter, to a transformer, or to a busbar.

2. The method according to claim 1, which further comprises:

placing the nanomaterial between the respective regions of the first portion and the second portion of the current path being connected to one another in at least one of a force-locking or form-locking manner, or extending the nanomaterial beyond the respective regions of at least one of the first portion or the second portion of the current path.

3. The method according to claim 1, which further comprises forming the first portion and the second portion of the current path from at least one of an identical conductive material or an identical material combination.

4. The method according to claim 1, which further comprises providing the nanomaterial by at least one of:

applying the nanomaterial to the respective region of at least one of the first portion or of the second portion of the current path, or including the nanomaterial on the respective region of at least one of the first portion or the second portion of the current path as at least one of a paste, a foil, a powder or a precursor.

5. The method according to claim 1, which further comprises using at least one connecting device to connect the first portion and the second portion of the current path in a force-locking manner in at least one region.

6. The method according to claim 4, which further comprises providing the connecting device as at least one of screws, rivets or clamps.

7. The method according to claim 1, which further comprises supplying the reaction energy to lead to a materially bonded connection between the first portion and the second portion of the current path, the materially bonded connection being locally limited to the first portion of the current path adjoining the nanomaterial and the second portion of the current path adjoining the nanomaterial.

8. The method according to claim 1, which further comprises supplying the reaction energy:

to the nanomaterial as at least one of thermal energy or electrical energy, or in another form being converted into at least one of thermal energy or electrical energy at least one of in or on the nanomaterial.

9. The method according to claim 1, which further comprises providing the materially bonded connection of the first portion and the second portion of the current path and the nanomaterial by at least one of:

creating the materially bonded connection by supplying the reaction energy, or basing the materially bonded connection on a sintering process of the nanomaterial, or including a sintering process in the materially bonded connection, or basing the materially bonded connection on welding of the first portion and the second portion of the current path due to an exothermic reaction of the nanomaterial or of a portion of the nanomaterial.

10. A switchgear installation for at least one of medium-voltage or high-voltage, the installation comprising:

a switchgear installation current path having at least one first portion and one second portion;

at least one of said first portion being an electrically conductive and flexible current conductor or a pole head or a current conductor clamp or said second portion being a connection to a moving contact or fixed contact of a vacuum interrupter, to a transformer, or to a busbar;

a nanomaterial in at least one region of at least one of said first portion or said second portion of said current path;

said first portion and said second portion of said current path being permanently connected to one another by a first connection in at least one of a force-locking or form-locking manner at least in said respective regions;

a conductive and materially bonded permanent second connection formed between said first portion and said second portion of said current path with participation of said nanomaterial due to supplied reaction energy; and said first permanent force-locking or form-locking connection configured to not be removed after forming said conductive and materially bonded permanent second connection.

* * * * *